US009777750B2

(12) United States Patent
Sugano et al.

(10) Patent No.: US 9,777,750 B2
(45) Date of Patent: Oct. 3, 2017

(54) HYDRAULIC DRIVING APPARATUS FOR WORKING MACHINE

(71) Applicants: Kobe Steel, Ltd., Kobe-shi (JP); KOBELCO CONSTRUCTION MACHINERY CO., LTD., Hiroshima-shi (JP)

(72) Inventors: Naoki Sugano, Kobe (JP); Takayuki Igaue, Kobe (JP); Mitsunori Hirozawa, Hiroshima (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 405 days.

(21) Appl. No.: 14/634,046

(22) Filed: Feb. 27, 2015

(65) Prior Publication Data

US 2015/0252820 A1 Sep. 10, 2015

(30) Foreign Application Priority Data

Mar. 10, 2014 (JP) ..... 2014-046419

(51) Int. Cl.
*F15B 11/10* (2006.01)
*F15B 13/042* (2006.01)
(Continued)

(52) U.S. Cl.
CPC ..... *F15B 11/10* (2013.01); *E02F 9/2246* (2013.01); *E02F 9/2296* (2013.01); *F02D 29/04* (2013.01);
(Continued)

(58) Field of Classification Search
CPC ..... E02F 9/2246; E02F 9/2296; F02D 29/04; F15B 11/10; F15B 13/042;
(Continued)

(56) References Cited

U.S. PATENT DOCUMENTS 4,697,418 A 10/1987 Okabe et al.
2008/0072588 A1 3/2008 Ariga et al.
(Continued)

FOREIGN PATENT DOCUMENTS

EP 0 214 633 A1 3/1987
EP 1 837 509 A1 9/2007
(Continued)

OTHER PUBLICATIONS

Extended European Search Report issued Sep. 7, 2015 in Patent Application No. 15157934.9.

*Primary Examiner* — Logan Kraft
(74) *Attorney, Agent, or Firm* — Oblon, McClelland, Maier & Neustadt, L.L.P.

(57) ABSTRACT

Provided is a hydraulic driving apparatus including a calculation section calculating a temporary target engine rotation speed corresponding to an engine operation amount, a calculation section calculating a temporary target pump displacement volume based on first-control and second-control target pump displacement volumes corresponding to an actuator operation amount and a pump load pressure, and a command section calculating a final target engine rotation speed and a final target pump displacement volume to output commands. The command section calculates a target pump discharge amount from the temporary target engine rotation speed and the temporary target pump displacement volume, sets the final target pump displacement volume to one larger than the temporary target pump displacement volume, and sets the final target engine rotation speed to one being lower than the temporary target engine rotation speed and allowing a pump discharge amount equivalent to the target pump discharge amount to be obtained.

6 Claims, 7 Drawing Sheets

(51) Int. Cl.
*E02F 9/22* (2006.01)
*F02D 29/04* (2006.01)

(52) U.S. Cl.
CPC ... *F15B 13/042* (2013.01); *F15B 2211/20546* (2013.01); *F15B 2211/25* (2013.01); *F15B 2211/2656* (2013.01); *F15B 2211/2658* (2013.01); *F15B 2211/6651* (2013.01); *F15B 2211/6652* (2013.01)

(58) Field of Classification Search
CPC ..... F15B 2211/20546; F15B 2211/25; F15B 2211/2656; F15B 2211/2658; F15B 2211/6651; F15B 2211/6652
See application file for complete search history.

(56) References Cited

U.S. PATENT DOCUMENTS

| | | | |
|---|---|---|---|
| 2010/0031650 | A1 | 2/2010 | Morinaga et al. |
| 2010/0167873 | A1 | 7/2010 | Akiyama et al. |
| 2011/0167811 | A1 | 7/2011 | Kawaguchi et al. |

FOREIGN PATENT DOCUMENTS

| | | | | | |
|---|---|---|---|---|---|
| GB | 2 457 401 | A | | 8/2009 | |
| JP | 2002188177 | A | * | 7/2002 | ..... E02F 9/2235 |
| JP | 4812843 | | | 11/2011 | |

* cited by examiner

HYDRAULIC DRIVING APPARATUS FOR WORKING MACHINE

TECHNICAL FIELD

The present invention relates to a hydraulic driving apparatus provided in a working machine such as a hydraulic excavator.

BACKGROUND ART

A general hydraulic driving apparatus provided in a working machine such as a hydraulic excavator includes an engine, a hydraulic pump driven by the engine to discharge a hydraulic fluid, and a hydraulic actuator supplied with hydraulic fluid to be actuated. Regarding an engine rotation speed, which is indicated by the number of rotations of the engine per unit time, a throttle lever is provided in a cab to be operated by an operator, and the engine rotation speed is controlled based on a target engine rotation speed corresponding to the amount of operation applied to the throttle lever.

However, in this technique, there can be a case where the rotation speed of the engine specified by use of the throttle lever is not coincident with the actuation speed of the hydraulic actuator desired by the operator. For example, even in the case where the operator does not require a high working speed for the hydraulic actuator, specifically, even in the case of a small amount of operation applied to the control lever for working by the operator, the engine rotation speed can be kept high if the amount of the operation applied to the throttle lever is large. This significantly hinders fuel efficiency from improvement.

As a technique for improving the fuel efficiency of the engine in the working machine as described above, known is an apparatus described in Japanese Patent No. 4812843. The apparatus includes a variable displacement hydraulic pump, pump-displacement-volume detection means for detecting the pump displacement volume of the variable displacement hydraulic pump, engine-rotation-speed command means for specifying the engine rotation speed, and setting means for setting a target engine rotation speed. The setting means sets a first target rotation speed in accordance with a command value specified by the engine rotation speed command means, and further a second target rotation speed lower than the first target rotation speed, controlling engine rotation speed based on the second target rotation speed of the engine. Improvement of the fuel efficiency of the engine is thereby encouraged.

Moreover, at the point in time when the pump displacement volume detected by the pump-displacement-volume detection means has increased to a first predetermined pump displacement volume or higher during an operation based on the second target rotation speed, the setting means changes the target rotation speed of the engine from the second target rotation speed to a third target rotation speed, which is higher than the second target rotation speed and equal to or lower than the first target rotation speed, to control the engine rotation speed. Thus secured is a pump discharge amount for operation where high-speed driving is required.

However, in the apparatus described in Japanese Patent No. 4812843, where the pump displacement volume of the hydraulic pump is controlled in accordance with the amount of operation of the control lever or a load on the hydraulic pump, it is impossible to sufficiently utilize the capability of the hydraulic pump for improvement of the fuel efficiency of the engine. On the other hand, there exists a requirement for performing control equivalent to the conventional control of the pump displacement volume, namely, positive control including increasing and decreasing the pump displacement volume based on the amount of operation of a control lever, i.e., an operation member for speed specification, and horsepower control including increasing and decreasing the pump displacement volume based on the load on the hydraulic pump so as to properly maintain the horsepower of the engine.

SUMMARY OF INVENTION

An object of the present invention is to provide a hydraulic driving apparatus for a working machine, the hydraulic driving apparatus including an engine and a variable displacement hydraulic pump driven by the engine and allowing fuel efficiency in the engine to be improved by effective utilization of the pump displacement volume of the hydraulic pump while performing control equivalent to the conventional positive control and horsepower control.

To accomplish the object, the inventors focused on the amount of hydraulic fluid discharged by the variable displacement hydraulic pump. Although there is conventionally adjusted a pump displacement volume of a hydraulic pump in accordance with an amount of operation of an actuator operation member such as a control lever used to specify the actuation speed of an actuator and a pump load pressure on the hydraulic pump to perform so called positive control and horsepower control, the positive control and the horsepower control can also be substantially achieved by bringing the actual pump discharge amount into correspondence with a target pump discharge pressure dependent on the amount of operation or the pump load pressure, even when the pump displacement volume does not correspond to the amount of operation of the actuator operation member or the pump load pressure, because the purpose of the conventional adjustment of the pump displacement volume is only for eventually controlling the pump discharge amount of the hydraulic pump. Hence, it is possible to suppress the actual engine rotation speed in comparison with the conventional control to thus improve the fuel efficiency, by setting the pump displacement volume on the large side while setting a target engine rotation speed to a value as allows the target pump discharge amount to be achieved in relationship with the pump displacement volume thus set on the large side.

The present invention has been achieved in view of the above-described points. Provided by the present invention is a hydraulic driving apparatus for a working machine, the apparatus including: an engine; at least one variable displacement hydraulic pump driven by the engine to discharge a hydraulic fluid; a hydraulic actuator supplied with the hydraulic fluid discharged by the at least one hydraulic pump to be thereby actuated; an engine operation member to which an operation for specifying a target rotation speed for the engine is applied; an actuator-operation member to which an operation for specifying a speed of actuation of the hydraulic actuator is applied; a pump-load-pressure detector that detects a load pressure on the at least one hydraulic pump; an engine-operation detector that detects an amount of the operation applied to the engine operation member; an actuator-operation detector that detects an amount of operation applied to the actuator operation member; and a controller that outputs a command for a pump displacement volume of the at least one hydraulic pump and a command for a rotation speed of the engine, based on the pump load pressure detected by the pump-load pressure detector and the amounts of respective operations detected by the engine-operation detector and the actuator-operation detector. The controller includes a temporary-target-engine-rotation-speed calculation section that calculates a temporary target engine rotation speed corresponding to the amount of operation applied to the engine operation member, a temporary-target-pump-displacement-volume calculation section that calculates a first-control target pump displacement volume corresponding to the amount of the operation applied to the actuator operation member and a second-control target pump displacement volume corresponding to the pump load pressure and selects a smaller one of the first-control target pump displacement volume and the second-control target pump displacement volume as a temporary target pump displacement volume for the at least one hydraulic pump, and a command section that calculates a final target engine rotation speed and a final target pump displacement volume based on the temporary target engine rotation speed and the temporary target pump displacement volume and output commands for the engine rotation speed and for the pump displacement volume based on the final target engine rotation speed and the final target pump displacement volume. In the case where the temporary target pump displacement volume is larger than a maximum pump displacement volume of the at least one hydraulic pump, the command section performs setting the final target engine rotation speed to the temporary target engine rotation speed and setting the final target pump displacement volume to the maximum pump displacement volume. In the case where the temporary target pump displacement volume is equal to or smaller than the maximum pump displacement volume of the at least one hydraulic pump, the command section performs: calculating a target pump discharge amount for an amount of hydraulic fluid discharged by the at least one hydraulic pump based on the temporary target engine rotation speed and the temporary target pump displacement volume: setting the final target pump displacement volume to a volume which is larger than the temporary target pump displacement volume and which is equal to or smaller than the maximum pump displacement volume; and setting the final target engine rotation speed to a specific engine rotation speed lower than the temporary target engine rotation speed, the specific engine rotation speed allowing a pump discharge amount equivalent to the target pump discharge amount to be obtained with the final target engine rotation speed and the final target pump displacement volume.

DESCRIPTION OF EMBODIMENTS

A preferred embodiment of the present invention will be described below with reference to the drawings.

Figure 1:
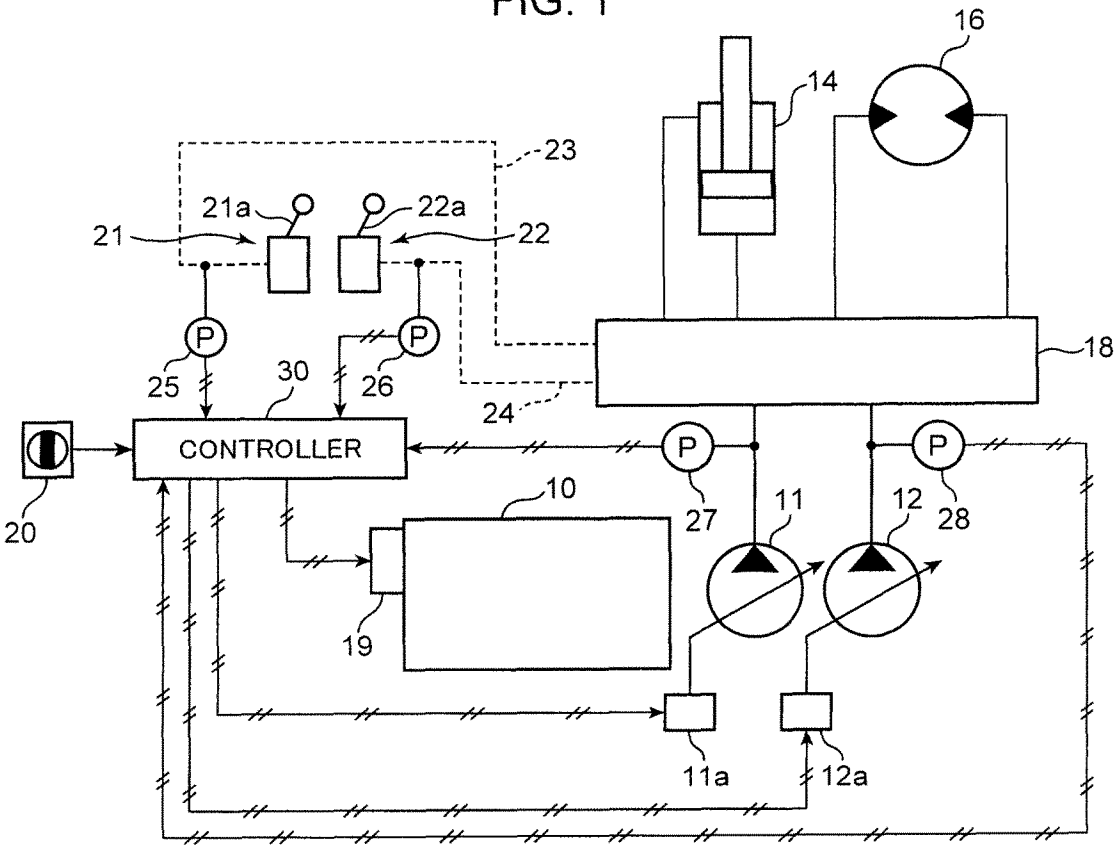
FIG. 1 is a circuit diagram showing a hydraulic driving apparatus for a working machine according to an embodiment of the present invention.

FIG. 1 shows a hydraulic driving apparatus for a working machine according to the embodiment. The hydraulic driving apparatus includes an engine 10, a first hydraulic pump 11, a second hydraulic pump 12, a plurality of hydraulic actuators including a hydraulic cylinder 14 and a hydraulic motor 16, a hydraulic control circuit 18, a throttle lever 20, a plurality of operation devices including remote control valves 21 and 22, a cylinder remote control valve 24, pilot-pressure sensors 25 and 26, pump-pressure sensors 27 and 28, and a controller 30.

The first and second hydraulic pumps 11 and 12 are coupled to an output shaft of the engine 10 and driven by the engine 10 to thereby discharge a hydraulic fluid in a tank independently of each other. The first and second hydraulic pumps 11 and 12 are of a variable displacement volume type and are provided with respective regulators 11*a* and 12*a*. Upon receiving an input of a pump-displacement-volume command described below, the regulators 11*a* and 12*a* are actuated so as to change respective pump displacement volumes of the first and second hydraulic pumps 11 and 12.

The hydraulic control circuit 18 is interposed between the first and second hydraulic pumps 11 and 12 and the plurality of hydraulic actuators to control the direction and flow rate of a hydraulic fluid fed from the first and second hydraulic pumps 11 and 12 to the hydraulic actuators. The hydraulic control circuit 18 includes a plurality of control valves provided for the respective hydraulic actuators. In the embodiment, each of the control valves comprises a pilot-controlled selector valve. The pilot-controlled selector valve is interposed between the corresponding hydraulic actuator and the hydraulic pump 11 or 12 assigned to the hydraulic actuator, making open-close movement in response to supply of pilot pressure to lead the hydraulic fluid to the hydraulic actuator at a flow rate corresponding to the pilot pressure. The hydraulic control circuit 18 according to the embodiment connects at least one hydraulic actuator including the hydraulic cylinder 14 to the first hydraulic pump 11, and connects at least one hydraulic actuator including the hydraulic motor 16 to the second hydraulic pump 12.

The throttle lever 20 includes a lever main body to which an operation for specifying a target engine rotation speed that is a target rotation speed for the engine 10 is applied, and a lever sensor that detects a throttle-lever operation amount Ls that is the amount of the operation applied to the lever main body. The lever main body corresponds to an "engine operation member" according to the present invention. The lever sensor corresponds to an "engine operation detector" according to the present invention. The lever sensor inputs an operation detection signal, which is an electric signal corresponding to the amount of operation of the lever sensor, into the controller 30.

The plurality of operation devices are provided for the respective hydraulic actuators, and an operation for activating each the hydraulic actuator is applied to the corresponding one of the operation devices. Specifically, the remote control valve 21 included in the plurality of operation devices corresponds to the hydraulic cylinder 14, and the remote control valve 22 corresponds to hydraulic motor 16. The remote control valves 21 and 22 include respective control levers 21*a* and 22*a* corresponding to "actuator operation members" according to the present invention, respectively, inputting respective pilot pressures corresponding to the amounts of respective operations applied to the control levers 21*a* and 22*a* into respective pilot ports of the control valves in the hydraulic control circuit 18, through pilot lines 23 and 24. The hydraulic cylinder 14 and the hydraulic motor 16 are thus supplied with the hydraulic fluid at flow rates corresponding to respective operations applied to the control levers 21*a* and 22*a* of the remote control valves 21 and 22, thereby being actuated at respective speeds corresponding to the flow rates. This also applies to the other hydraulic actuators.

The pilot-pressure sensors 25 and 26 detect respective parameters corresponding to the amounts of respective operations of the control levers 21*a* and 22*a*, namely, respective pilot pressures Pt1 and Pt2 in the pilot lines 23, 24. The pilot-pressure sensors 25 and 26, thus providing "actuator operation detectors" according to the present invention, inputs respective pilot-pressure detection signals, which are respective electric signals corresponding to the pilot pressures Pt1 and Pt2, to the controller 30. FIG. 1 shows only the single pilot line 23 and the single pilot line 24 for the single remote control valve 21 and the single remote control valve 22, respectively, for convenience; however, in actual, there are installed a pair of pilot lines for the remote control valves 21 and 22, respectively, in association with respective operating directions of the control levers 21*a* and 22*a*, and the pilot-pressure sensors are provided for the respective pilot lines.

The pump-pressure sensors 27 and 28 detect respective pressures of the hydraulic fluid discharged by the first and second hydraulic pumps 11 and 12, respectively, namely, respective pump load pressures Pp1 and Pp2. The pump-pressure sensors 27 and 28, thus providing "pump load pressure detectors" according to the present invention, inputs respective pump load pressure detection signals, which are respective electric signals corresponding to the pump load pressures Pp1 and Pp2, to the controller 30.

The controller 30 produces and outputs pump-displacement-volume commands for respective pump displacement volumes of the hydraulic pumps 11 and 12 and an engine rotation speed command for the rotation speed of the engine 10, based on pump load pressures Pp1 and Pp2 detected by the respective pump-pressure sensors 27 and 28, the amount of operation applied to the lever main body of the throttle lever 20, namely, the throttle-lever operation amount Ls, and the pilot pressures Pt1 and Pt2 detected by the respective pilot-pressure sensors 25 and 26, namely, parameters corresponding to the amounts of respective operations of the control levers 21*a* and 22*a* of the remote control valves 21 and 22. The pump displacement volume commands, which include respective final target pump displacement volumes qf1 and qf2 as to the pump displacement volumes of the respective hydraulic pumps 11 and 12, are input to the regulators 11*a* and 12*a* attached to the hydraulic pumps 11 and 12, respectively. The engine rotation speed command, which includes a final target engine rotation speed Nf as to the rotation speed of the engine 10, is input to an engine ECU 19.

Figure 2:
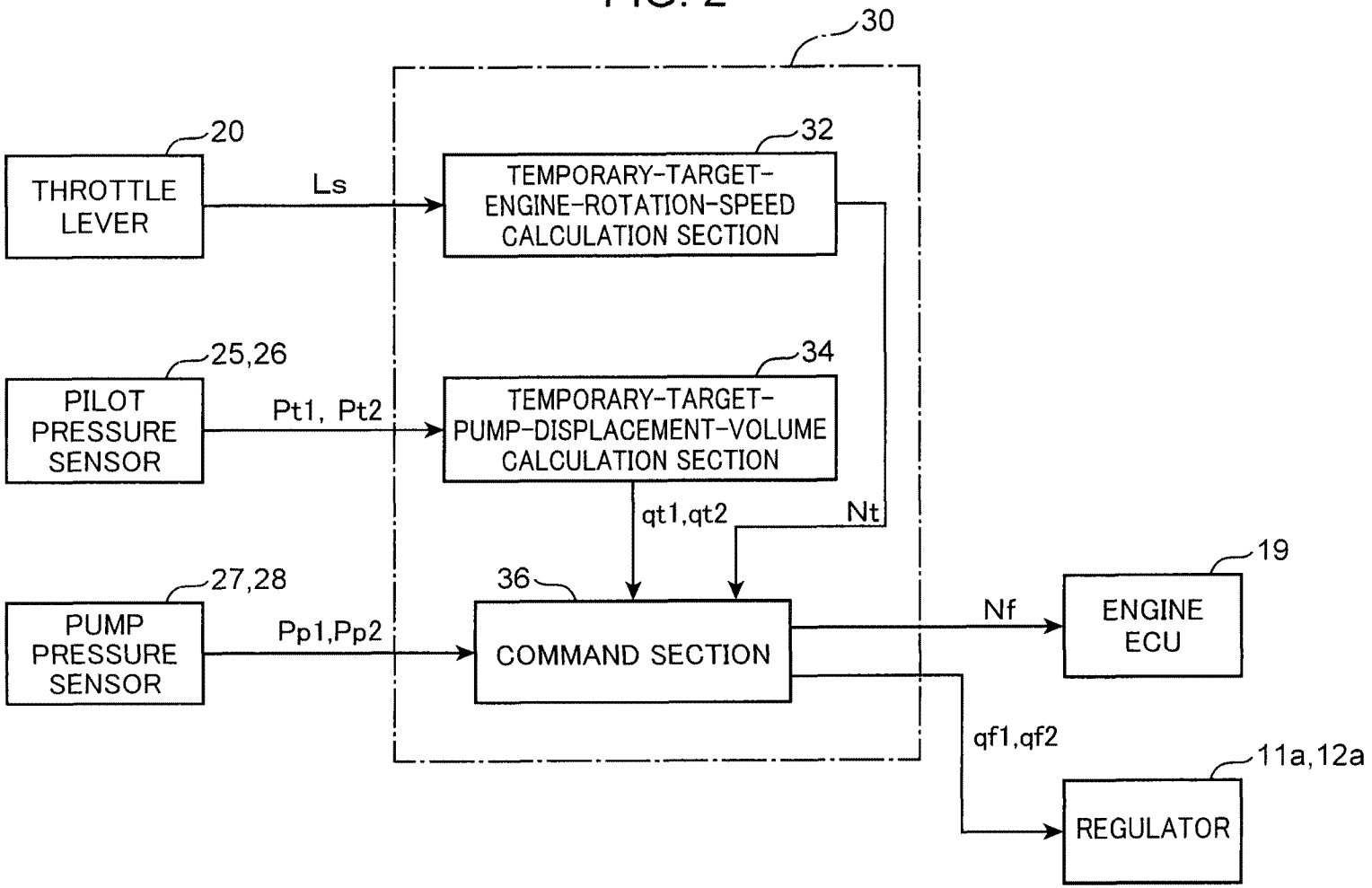
FIG. 2 is a block diagram showing a functional configuration of a controller in the hydraulic driving apparatus.

The controller 30 includes, as elements for performing such calculation control operations, a temporary-target-engine-rotation-speed calculation section 32, a temporary-target-pump-displacement-volume calculation section 34, and a command section 36 as shown in FIG. 2.

The temporary-target-engine-rotation-speed calculation section 32 calculates a temporary target engine rotation speed Nt corresponding to the amount of the operation applied to the lever main body of the throttle lever 20 as the engine operation member, namely, the throttle-lever operation amount Ls.

The temporary-target-pump-displacement-volume calculation section 34 executes the following calculations:

a) calculating, for the first hydraulic pump 11, a positive-control target pump displacement volume (first-control target pump displacement volume; hereinafter referred to as a "PC target pump displacement volume") qp1 corresponding to the amount of operation of at least one actuator operation member including the control lever 21*a* (in the embodiment, corresponding to a pilot pressure varying in accordance with the amount of operation and including at least the pilot pressure Pt1);

b) calculating, for the second hydraulic pump 12, a PC target pump displacement volume qp2 corresponding to the amount of operation of at least one actuator operation member including the control lever 22*a* (in the embodiment, corresponding to a pilot pressure varying in accordance with the amount of operation and including at least the pilot pressure Pt2);

c) calculating a horsepower-control target pump displacement volume (second-control target pump displacement volume) qh corresponding to the pump load pressures Pp1 and Pp2 on the respective hydraulic pumps 11 and 12; and d) individually comparing PC target pump displacement volumes qp1 and qp2 calculated for the first and second hydraulic pumps 11 and 12, respectively, with the horsepower-control target pump displacement volume qh to select the smaller pump displacement volumes as temporary target pump displacement volumes qt1 and qt2, respectively.

The command section 36 calculates a final target engine rotation speed Nf and final target pump displacement volumes qf1 and qf2 for the respective hydraulic pumps 11 and 12 based on the temporary target engine rotation speed Nt and the temporary target pump displacement volumes qt1 and qt2, and, based on the final target engine rotation speed Nf and the final target pump displacement volumes qf1 and qf2, the command section 36 outputs the engine rotation speed command and the pump-displacement-volume command.

Next will be described the contents of specific calculation and control made by the controller 30, with reference to a flowchart in FIG. 3, a time chart in FIG. 4, and graphs in FIGS. 5 to 7.

Figure 3:
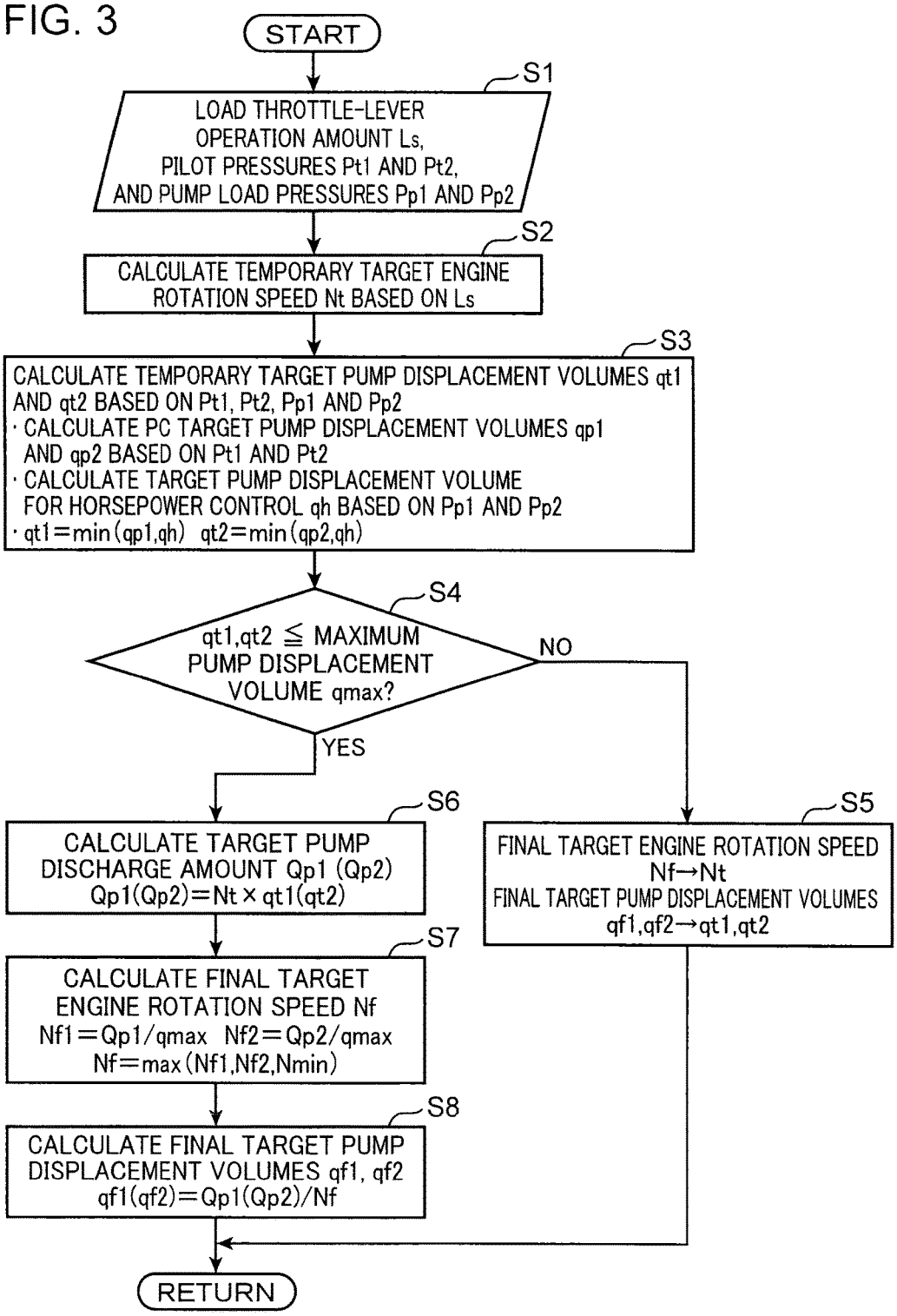
FIG. 3 is a flowchart showing a calculation control operation of the controller.

(1) Loading Information (Step S1 in FIG. 3).

The controller 30 first loads information through detection signals input thereinto from the sensors. Specifically, the controller 30 loads information on the throttle-lever operation amount Ls, a plurality of pilot pressures including the pilot pressures Pt1 and Pt2, and the pump load pressures Pp1 and Pp2.

(2) Calculation of Temporary Target Engine Rotation Speed (Step S2 in FIG. 3).

The temporary-target-engine-rotation-speed calculation section 32 of the controller 30 calculates the temporary target engine rotation speed Nt based on the throttle-lever operation amount Ls. This calculation is executed based on relational expressions and/or maps preliminarily provided in association with the throttle-lever operation amount Ls and the temporary target engine rotation speed Nt. In the embodiment, the temporary-target-engine-rotation-speed calculation section 32 stores such a relationship between the throttle-lever operation amount Ls and the temporary target engine rotation speed Nt as shown in FIG. 5, and, based on the relationship, determines the temporary target engine rotation speed Nt. According to the relationship shown in FIG. 5, given is such a temporary target engine rotation speed Nt as increases with increase in the throttle-lever operation amount Ls within the range between a lower limit Nmin and an upper limit Nmax of the target engine rotation speed.

(3) Caluculation of Temporary Target Pump Displacement Volumes Qt1 and Qt2 (Step S3 in FIG. 3).

On the other hand, the temporary-target-pump-displacement-volume calculation section 34 of the controller 30 calculates the temporary target pump displacement volumes qt1 and qt2 of the respective first and second hydraulic pumps 11 and 12 based on a plurality of pilot pressures including the pilot pressures Pt1 and Pt2 corresponding to the respective amounts of operations applied to the respective control levers 21*a* and 22*a* and the pump load pressures Pp1 and Pp2 on the respective first and second hydraulic pumps 11 and 12. The detail is as follows.

(3-1) Calculation of PC Target Pump Displacement Volumes qp1 and qp2

The temporary-target-pump-displacement-volume calculation section 34 calculates the PC (positive-control) target pump displacement volumes qp1 and qp2, that is, target pump discharge amounts for performing control based on an actuator actuation speed required by the operator, for the first and second hydraulic pumps 11 and 12, respectively, based on the respective pilot pressures for the hydraulic pumps. This calculation is executed based on relational expressions and/or maps preliminarily provided in association with the pilot pressures and the PC target pump displacement volumes qp1 and qp2.

Figure 6:
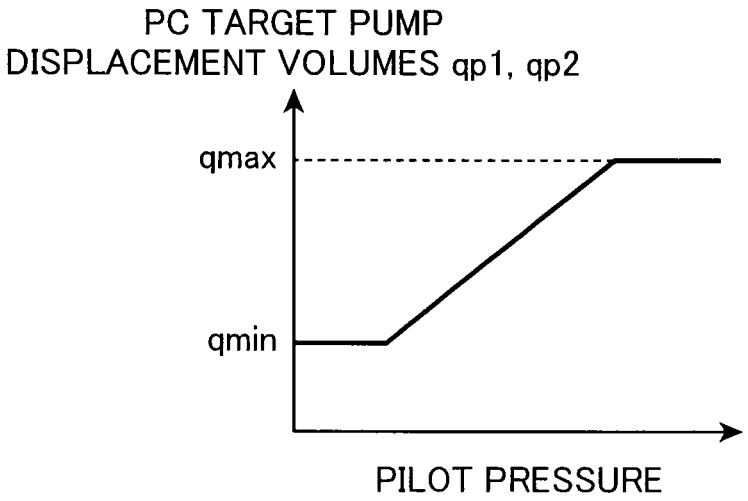
FIG. 6 is a graph showing the relation between the amount of operation of a motor control lever in the hydraulic driving apparatus and a target engine rotation speed for positive control calculated by the controller.

Specifically, the temporary-target-pump-displacement-volume calculation section 34 stores such a relationship between the pilot pressure and the PC target pump displacement volume as shown in FIG. 6, and, based on this relationship, determines the PC target pump displacement volume corresponding to each of the pilot pressures. According to the relationship shown in FIG. 6, given is such a PC target pump displacement volume qp as increases with increase in the pilot pressure within the range between a lower limit qmin and an upper limit qmax of the pump displacement volume.

In the case where what is connected to each of the first and second hydraulic pumps 11 and 12 is a single hydraulic actuator, specifically, in the case where the hydraulic actuator connected to the first hydraulic pump 11 is only the hydraulic cylinder 14 and the hydraulic actuator connected to the second hydraulic pump 12 is only the hydraulic motor 16, the PC target pump displacement volumes qp1 and qp2 for the respective first and second hydraulic pumps 11 and 12 are determined based on the pilot pressures Pt1 and Pt2 of the respective remote control valves 21 and 22 corresponding to the hydraulic cylinder 14 and the hydraulic motor 16, respectively.

In contrast, in the case where a plurality of hydraulic actuators are connected to at least one of the first and second hydraulic pumps 11 and 12, calculated as the final PC target pump displacement volumes qp1 and qp2 are the respective sums of the PC target pump displacement volumes determined based on the pilot pressures corresponding to the respective hydraulic actuators. For example, in the case where the hydraulic cylinder 14 and another hydraulic actuator are connected to the first hydraulic pump 11, calculated as the PC target pump displacement volume qp1 for the first hydraulic pump 11 is the sum of the PC target pump displacement volume corresponding to the pilot pressure PO for the hydraulic cylinder 14 and the PC target pump displacement volume corresponding to the pilot pressure for the other hydraulic actuator. In the case where the sum exceeds the maximum value of the preset PC target pump displacement volume qp1, the maximum value is set to the PC target pump displacement volume qp1 regardless of the actual value of the sum. This calculation is similarly applied to calculation of the PC target pump displacement volume qp2 of the second hydraulic pump 12.

(3-2) Calculation of Horsepower-Control Target Pump Displacement Volume

The temporary-target-pump-displacement-volume calculation section 34 calculates the horsepower-control target pump displacement volume qh, that is, a target pump displacement volume for performing such control as to maintain the engine horsepower within a preferable range, based on the pump load pressures Pp1 and Pp2 detected for the respective first and second hydraulic pumps 11 and 12. This calculation is executed based on relational expressions and/or maps preliminarily provided in association with the pump load pressures Pp1 and Pp2 and the horsepower-control target pump displacement volume qh.

Figure 7:
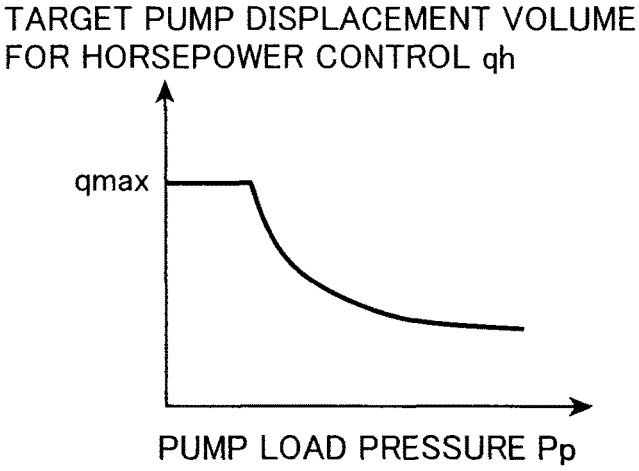
FIG. 7 is a graph showing the relation between a pump load pressure on a hydraulic pump in the hydraulic driving apparatus and a target engine rotation speed for horsepower control calculated by the controller.

Specifically, the temporary-target-pump-displacement-volume calculation section 34 according to the embodiment stores such a relationship between the horsepower-control target pump displacement volume qh and the pump load pressures Pp1 and Pp2 as shown in FIG. 7, and, based on this relationship, calculates the horsepower-control target pump displacement volume qh corresponding to each of the pump load pressures Pp1 and Pp2. The temporary-target-pump-displacement-volume calculation section 34 then determines, for example, the mean value of the horsepower-control target pump displacement volumes qh, as the final horsepower-control target pump displacement volume qh. The thus determined horsepower-control target pump displacement volume qh is shared, as also described below, for the control of the respective pump displacement volumes of the first and second hydraulic pumps 11 and 12. According to the relation shown in FIG. 7, given is such a horsepower-control target pump displacement volume qh as decreases substantially in reverse proportion with increase in pump load pressure Pp within a range equal or below the upper limit qmax of the pump displacement volume.

(3-3) Determination of Temporary Target Pump Displacement Volumes qt1 and qt2

The temporary-target-pump-displacement-volume calculation section 34 determines the temporary target pump displacement volumes qt1 and qt2 for the first and second hydraulic pumps 11 and 12, respectively, based on the PC target pump displacement volumes qp1 and qp2 calculated for the respective first and second hydraulic pumps 11 and 12 and the horsepower-control target pump displacement volume qh shared for the first and second hydraulic pumps 11 and 12. Specifically, the PC target pump displacement volumes qp and the horsepower-control target pump displacement volume qh for the respective first and second hydraulic pumps 11 and 12 are brought into individual comparison with each other, and the smaller ones of the pump displacement volumes are adopted as the respective temporary target pump displacement volumes qt1 and qt2 for the first and second hydraulic pumps 11 and 12. This means that the temporary target pump displacement volumes qt1 and qt2 of the respective first and second hydraulic pumps 11 and 12 are given by the following expressions, respectively.

$$qt1=\min(qp1,qh) \quad (1A)$$

$$qt2=\min(qp2,qh) \quad (1B).$$

(4) Calculation of Final Target Engine Rotation Speed Nf and Final Target Pump Displacement Volume of (steps S4 to S8 in FIG. 3).

As described below, the command section 36 of the controller 30 calculates the final target engine rotation speed Nf and also calculates the final target pump displacement volumes qf1 and qf2 for the respective first and second hydraulic pumps 11 and 12.

First, in the case where the at least one of the temporary target pump displacement volumes qt1 and qt2 calculated for the respective first and second hydraulic pumps 11 and 12 is larger than the maximum pump displacement volume qmax of the hydraulic pumps 11 and 12 (step S4, NO), the utilization of the pump displacement volume beyond the conventional normal control being impossible in this case, the command section 36 sets the temporary target pump displacement volumes qt1 and qt2 to the final target pump displacement volumes qf1 and qf2 directly without any change and sets the temporary target engine rotation speed Nt to the final target engine rotation speed Nt directly without any change, as is the case with the conventional control (step S5).

On the other hand, in the case where each of the temporary target pump displacement volumes qt1 and qt2 is equal to or smaller than the maximum pump displacement volume qmax of the hydraulic pumps 11 and 12 (step S4, YES), the command section 36 performs calculation control with full utilization of the pump displacement volumes of the hydraulic pumps 11 and 12 to reduce the target engine rotation speed.

First, based on the temporary target engine rotation speed Nt and the temporary target pump displacement volumes qt1 and qt2, the command section 36 calculates target pump discharge amounts Qp1 and Qp2 for the respective first and second hydraulic pumps 11 and 12, the target pump discharge amounts Qp1 and Qp2 being to be obtained by use of the engine rotation speed and the pump displacement volumes (step S6). The target pump discharge amounts Qp1 and Qp2 are given by:

$$Qp1=Nt\times qt1 \quad (2A)$$

$$Qp2=Nt\times qt2 \quad (2B).$$

Under the satisfaction of each of the target pump discharge amounts Qp1 and Qp2, even when the actual pump displacement volume is larger than the PC target pump displacement volumes qp1 and qp2 and the horsepower-control target pump displacement volume qh (for example, even when the actual pump displacement volume is set to the maximum pump displacement volume qmax), reducing the target engine rotation speed enables positive control and horsepower control to be virtually achieved. In other words, it is possible to reduce the target engine rotation speed by effective utilization of the pump displacement volume to thereby improve fuel efficiency while performing the control corresponding to the positive control and the horsepower control.

From this view, the command section 36 makes inverse operation for obtaining provisional target engine rotation speeds Nf1 and Nf2 for the respective first and second hydraulic pumps 11 and 12 from the target pump discharge amount Qp and the maximum pump displacement volume qmax, and selects the highest one of the values including the provisional target engine rotation speeds Nf1 and Nf2 and a preset minimum target engine rotation speed Nmin as the final target engine rotation speed Nf (step S7). In other words, the final target engine rotation speed Nf is given by:

$$Nf1=Qp1/q\max \quad (3A)$$

$$Nf2=Qp2/q\max \quad (3B)$$

$$Nf=\max(Nf1,Nf2,N\min) \quad (3C).$$

Figure 8:
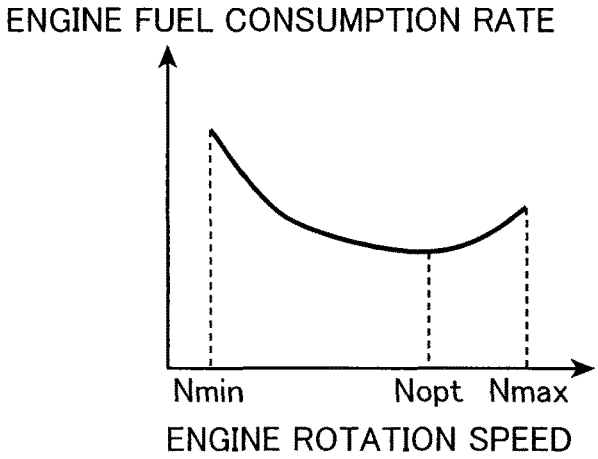
FIG. 8 is a graph showing the relationship between the rotation speed of an engine in the hydraulic driving apparatus and a fuel consumption rate.

The reason why the choices include the minimum target engine rotation speed Nmin in addition to the provisional target engine rotation speeds Nf1 and Nf2 is to prevent the target engine rotation speed from excessive decrease, for example, from decrease which can rather degrade fuel efficiency. Since the fuel consumption rate of the engine is minimized at a particular engine rotation speed Nopt as shown in FIG. 8, the minimum target engine rotation speed Nmin is set to the particular engine rotation speed Nopt or a rotation speed adjacent to the particular engine rotation speed Nopt.

Moreover, the command section 36 calculates the final target pump displacement volumes qf1 and qf2 for the respective first and second hydraulic pumps 11 and 12, based on the final target engine rotation speed Nf and the target pump discharge amounts Qp1 and Qp2 (step S8). The final target pump displacement volumes qf1 and qf2 are given by:

$$qf1=Qp1/Nf \quad (4A)$$

$$qf2=Qp2/Nf \quad (4B).$$

As is apparent from Equations (4A) and (4B) and Equations (2A) and (2B) described above, the pump discharge amounts Qp1 and Qp2 of the respective first and second hydraulic pumps 11 and 12 obtained by use of the final target engine rotation speed Nf and the final target pump displacement volumes qf1 and qf2 (Qp1=Nf×qf1 and Qp2=Nf×qf2) are equal to the pump discharge amounts obtained by use of the temporary target engine rotation speed Nt and temporary target pump displacement volumes qt1 and qt2.

The command section 36 inputs an engine rotation speed command including the final target engine rotation speed Nf and the first and second pump-displacement-volume commands including the respective final target pump displacement volumes qf1 and qf2 into the engine ECU 19 and the regulators 11a and 12a, respectively. Thereby performed are engine rotation speed control and pump displacement volume control capable of improving the fuel efficiency of the engine 10 while securing a pump discharge amount enough to achieve positive control or horsepower control.

Figure 4:
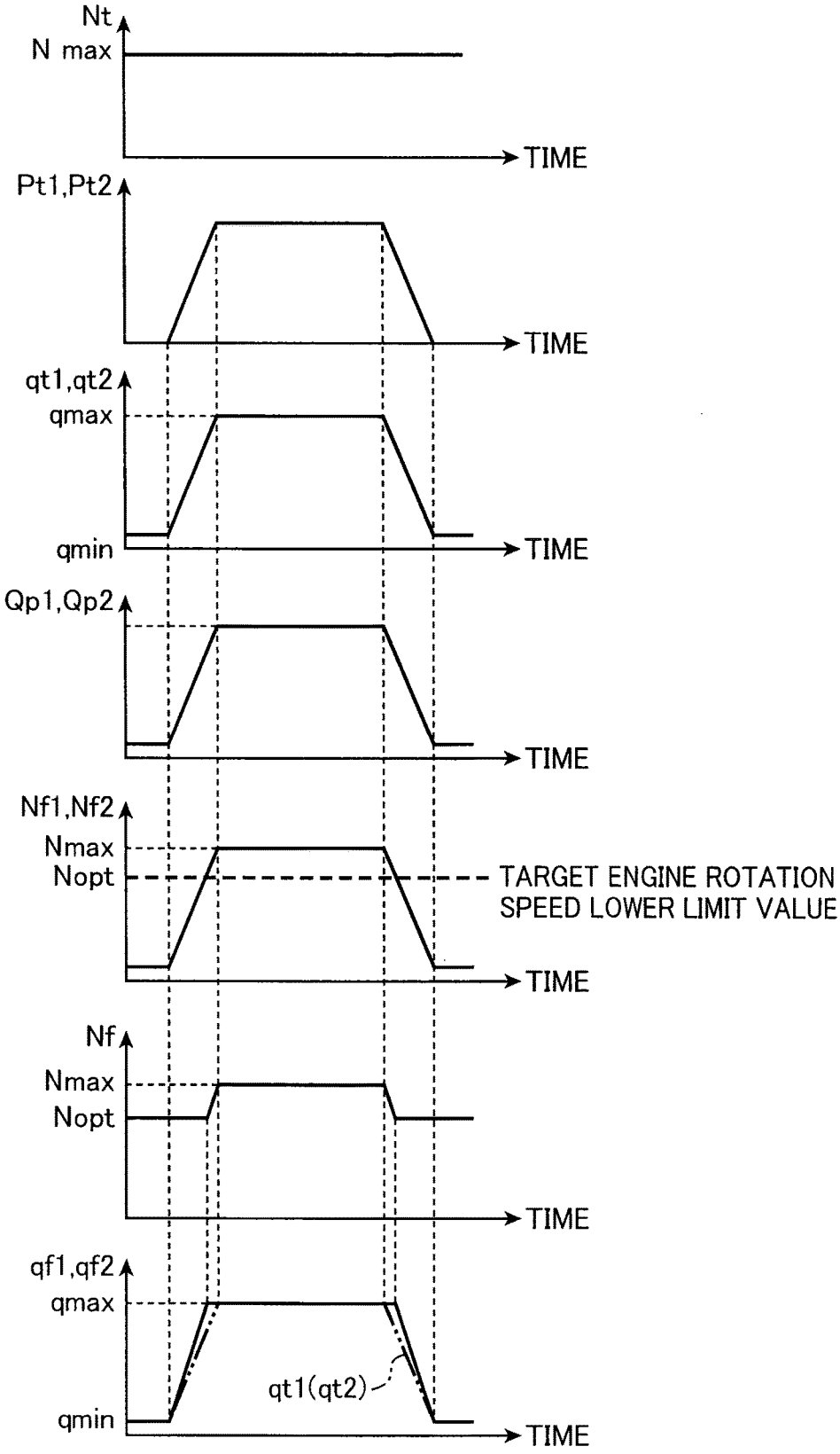
FIG. 4 is a time chart showing the calculation control operation of the controller.
Figure 5:
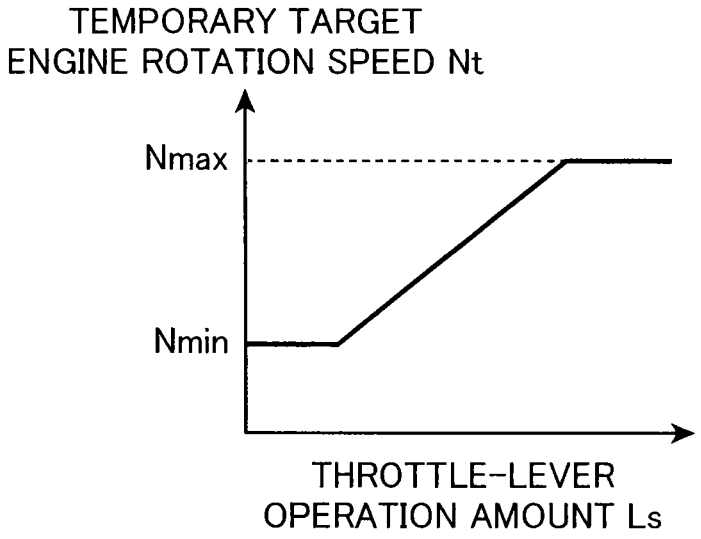
FIG. 5 is a graph showing the relationship between the amount of operation applied to a throttle lever in the hydraulic driving apparatus and a temporary target engine rotation speed calculated by the controller.

The time chart in FIG. 4 show temporal changes in the relevant values corresponding to the operations applied to the respective control levers 21a, 22a under the following condition: the pilot pressures related to the first and second hydraulic pumps 11 and 12 are only the pilot pressures Pt1 and Pt2; the pump load pressures Pp1 and Pp2 are relatively low and the horsepower-control target pump displacement volume qh is qmax; and the operation amount Ls of the throttle lever 20 is maximum. In this case, the temporary target pump displacement volumes qt1 and qt2 are dependent on the positive-control pump displacement volumes qt1 and qt2, thus varying only in association with the pilot pressures Pt1 and Pt2. Hence, while the pilot pressures Pt1 and Pt2 are low, in other words, while the amounts of operations applied to the respective control levers 21*a* and 22*a* are small, each of the temporary target pump displacement volumes qt1 and qt2 and the target pump discharge amounts Qp1 and Qp2 has the minimum value. Although the gradual increases in the amounts of operations of the respective control levers 21*a* and 22*a* from the minimum value increase the temporary target pump displacement volumes qt1 and qt2, setting the final target pump displacement volumes qf1 and qf2 to be respective values larger than the temporary target pump displacement volumes qt1 and qt2 (the lowermost stage in FIG. 4) allows the final target engine rotation speed Nf to be kept at the minimum target engine rotation speed (for example, at the engine rotation speed Nopt making fuel efficiency minimum) for a long period of time, thereby allowing reduction in fuel efficiency by effective utilization of the pump displacement volumes of the first and second hydraulic pumps 11 and 12 to be achieved.

When the pump load pressures Pp1 and Pp2 are high, the horsepower-control target pump displacement volume qh is dominant, thus adopted as the temporary target pump displacement volumes qt1 and qt2. If the final target pump displacement volume is unconditionally set to the maximum pump displacement volume or a value close to the maximum pump displacement volume even in such a case, the absorption torques of the hydraulic pumps 11 and 12 may undesirably exceed an allowable value to overload the engine 10.

Figure 9:
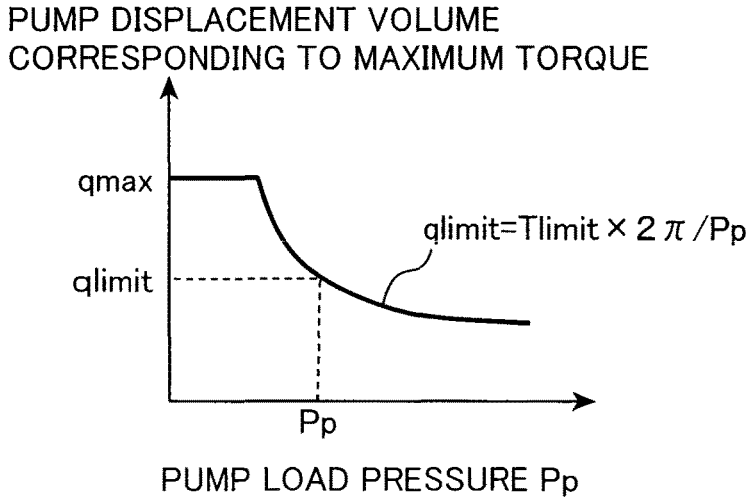
FIG. 9 is a graph showing the relation between the pump load pressure on the hydraulic pump and a pump displacement volume corresponding to a maximum pump absorption torque.

For the reason, it is preferable that the command section 36 sets the final target pump displacement volumes qf1 and qf2 in such a range that the pump absorption torques corresponding to the respective final target pump displacement volumes qf1 and qf2 do not exceed a preset maximum torque. This enables the pump absorption torques to be prevented from excessive increase which may cause an engine failure. Specifically, since the limited pump displacement volume qlimit corresponding to the maximum torque (limited torque) Tlimit at which the engine 10 can avoid overload decreases with increase in the pump load pressure Pb as shown in FIG. 9, it is preferable to determine the final target pump displacement volume qf in a range equal to or below the limited pump displacement volume qlimit. Specifically, the limited pump displacement volume qlimit is given by:

$$q\text{limit}=T\text{limit}\times 2\pi/Pp1 \text{ (or } Pp2\text{)}.$$

Figure 10:
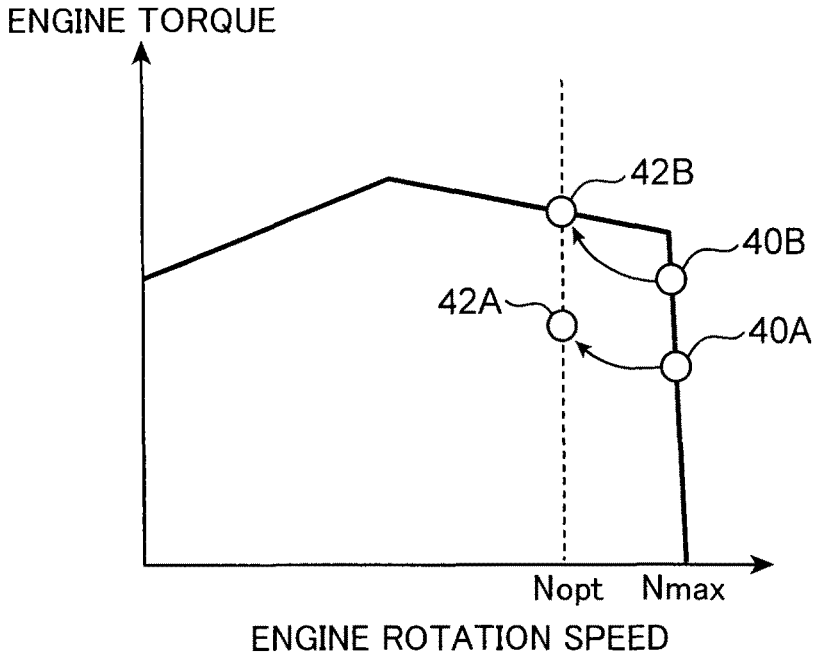
FIG. 10 is a graph showing an increase in engine torque associated with a decrease in engine rotation speed in the hydraulic driving apparatus in the case of no limitation of an increase in the pump displacement volume of the hydraulic pump.

Specific advantages of the limitation of the absorption torque will be described with use of case examples shown in FIG. 10 and FIG. 11. FIG. 10 shows an example of increasing the final target pump displacement volume with no limitation on the pump absorption torque to reduce the target engine rotation speed. As to the example, it is assumed to increase the pump displacement volume unconditionally to reduce the final target engine rotation speed Nf down to the engine rotation speed Nopt which makes fuel efficiency minimum, when the temporary target engine rotation speed Nt corresponding to the amount of operation of the throttle lever 20 corresponds to the engine rotation speed maximum value Nmax. In this assumed case, reducing the engine rotation speed from a point 40A where the engine torque is originally low involves no problem, but reducing the engine rotation speed from a point 40B where the engine torque is originally high causes the engine torque to reach the maximum value (at the point 42B), thus generating a state where inconvenience due to overload of the engine 10 is likely to be caused.

Figure 11:
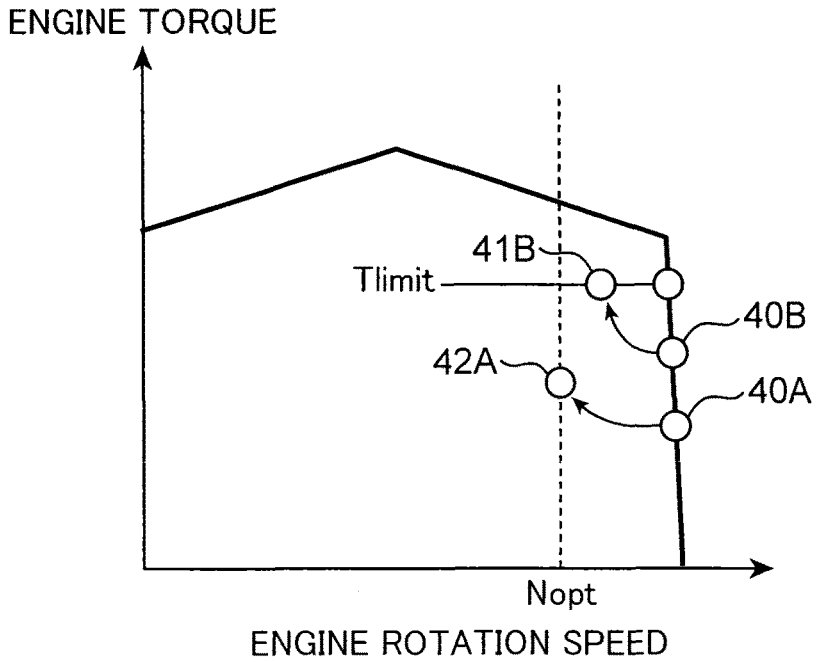
FIG. 11 is a graph showing an increase in engine torque associated with a decrease in engine rotation speed in the hydraulic driving apparatus in the case of limitation of an increase in the pump displacement volume of the hydraulic pump.

In contrast, in the case of limiting the pump absorption torque as shown in FIG. 11, that is, in the case of setting the final target pump displacement volume qf in such a range that the pump absorption torque is equal to or lower than the maximum torque (limited torque Tlimit), the decrease in engine rotation speed from the point 40B is limited within such a range that the engine torque does not exceed Tlimit (point 41B), the inconvenience due to the overload of the engine 10 thus being prevented.

While the calculation control shown in the flowchart in FIG. 3 includes setting the maximum pump displacement volume qmax to the final target pump displacement volume of as a pump displacement volume larger than the temporary target pump displacement volumes qt1 and qt2, the set value for the final target pump displacement volume according to the present invention is not required to be the maximum pump displacement volume qmax, but may be, for example, a value obtained by multiplying the maximum pump displacement volume qmax by a coefficient slightly smaller than 1. Even in this case, calculating such a final target engine rotation speed as allows the target pump discharge amount to be achieved in corporation with the final target pump displacement volume (the final target engine rotation speed<the temporary target engine rotation speed) enables positive control and horsepower control to be performed.

The present invention permits another limitation to be imposed on increasing pump displacement volume as described above, that is, on setting a final target pump displacement volume larger than the temporary target pump displacement volume. For example, in the case of positioning the control levers 21*a* and 22*a* in a neutral position or in a position adjacent thereto, increasing the pump displacement volume is not absolutely desirable because the working machine is performing substantially no work, hence not requiring a pump discharge amount equivalent to the conventional pump discharge amount; in such a case, there may be exceptionally made such a correction that the pump displacement volume approaches a minimum volume grain as the actuator operation member approaches the neutral position. In this case, although the pump discharge amount obtained based on the final target engine rotation speed and the final target pump displacement volume is slightly smaller than the target pump discharge amount, this does not significantly affect operability.

The command section according to the present invention preferably performs control including suppressing a fluctuation in the final target engine rotation speed regardless of a fluctuation in the temporary target pump displacement volume, in the case where the final target engine rotation speed is equal to or higher than the set value, for example, when the final target engine rotation speed reaches a value close to the maximum engine rotation speed. This control enables a specific problem on operability to be solved: the problem is, for example, that the engine rotation speed may fluctuate by following the frequent fluctuation of the amount of operation of the actuator operation member or the pump load pressure to thus degrade operability. Specifically, during the period from the point in time when the final target engine rotation speed becomes equal to or higher than the set value until a point when a preset time has elapsed, it is preferable to perform control including maintaining the engine rotation speed instead of reducing it even under a condition where the final target engine rotation speed should be reduced, or control including limiting a time-varying gain for the final target engine rotation speed to a preset value or smaller.

The number of hydraulic pumps included in the hydraulic driving apparatus according to the present invention is not limited. For example, an apparatus according to the invention may include only a single hydraulic pump: in this case, only a single value has to be calculated for each of the PC target pump displacement volume, the temporary target pump displacement volume, the target pump discharge amount, and the final target pump displacement volume.

As described above, provided is a hydraulic driving apparatus for a working machine, the hydraulic driving apparatus including an engine and a variable displacement hydraulic pump driven by the engine and allowing fuel efficiency in the engine to be improved by effective utilization of the pump displacement volume of the hydraulic pump while performing control equivalent to the conventional positive control and horsepower control. The apparatus includes: an engine; at least one variable displacement hydraulic pump driven by the engine to discharge a hydraulic fluid; a hydraulic actuator supplied with the hydraulic fluid discharged by the at least one hydraulic pump to be thereby actuated; an engine operation member to which an operation for specifying a target rotation speed for the engine is applied; an actuator-operation member to which an operation for specifying a speed of actuation of the hydraulic actuator is applied; a pump-load-pressure detector that detects a load pressure on the at least one hydraulic pump; an engine-operation detector that detects an amount of the operation applied to the engine operation member; an actuator-operation detector that detects an amount of operation applied to the actuator operation member; and a controller that outputs a command for a pump displacement volume of the at least one hydraulic pump and a command for a rotation speed of the engine, based on the pump load pressure detected by the pump-load pressure detector and the amounts of respective operations detected by the engine-operation detector and the actuator-operation detector. The controller includes a temporary-target-engine-rotation-speed calculation section that calculates a temporary target engine rotation speed corresponding to the amount of operation applied to the engine operation member, a temporary-target-pump-displacement-volume calculation section that calculates a first-control target pump displacement volume corresponding to the amount of the operation applied to the actuator operation member and a second-control target pump displacement volume corresponding to the pump load pressure and selects a smaller one of the first-control target pump displacement volume and the second-control target pump displacement volume as a temporary target pump displacement volume for the at least one hydraulic pump, and a command section that calculates a final target engine rotation speed and a final target pump displacement volume based on the temporary target engine rotation speed and the temporary target pump displacement volume and output commands for the engine rotation speed and for the pump displacement volume based on the final target engine rotation speed and the final target pump displacement volume. In the case where the temporary target pump displacement volume is larger than a maximum pump displacement volume of the at least one hydraulic pump, the command section performs setting the final target engine rotation speed to the temporary target engine rotation speed and setting the final target pump displacement volume to the maximum pump displacement volume. In the case where the temporary target pump displacement volume is equal to or smaller than the maximum pump displacement volume of the at least one hydraulic pump, the command section performs: calculating a target pump discharge amount for an amount of hydraulic fluid discharged by the at least one hydraulic pump based on the temporary target engine rotation speed and the temporary target pump displacement volume: setting the final target pump displacement volume to a volume which is larger than the temporary target pump displacement volume and which is equal to or smaller than the maximum pump displacement volume; and setting the final target engine rotation speed to a specific engine rotation speed lower than the temporary target engine rotation speed, the specific engine rotation speed allowing a pump discharge amount equivalent to the target pump discharge amount to be obtained with the final target engine rotation speed and the final target pump displacement volume.

The apparatus enables the fuel efficiency of the engine to be improved by effective utilization of the pump displacement volume of the variable displacement hydraulic pump. For example, in the case where the operator applies a great operation to the engine operation member but the amount of operation applied to the actuator operation member is so small that a high actuator speed is not required, calculated is a final target pump displacement volume which is larger than the temporary target pump displacement volume (that is, the target pump displacement volume calculated based on the amount of operation of the actuator operation member and the pump load pressure) within such a range that the final target pump displacement volume for the hydraulic pump does not exceed the pump maximum displacement volume, and, in correspondence with this, a final target engine rotation speed lower than the temporary target engine rotation speed corresponding to the engine operation member is calculated. The actual engine rotation speed is, thus, restrained automatically to allow fuel efficiency to be improved. Moreover, the final pump displacement volume and the final target engine rotation speed are set such that the pump discharge amount of the hydraulic pump obtained based on the pump displacement volume and the final target engine rotation speed is equivalent to the target pump discharge amount calculated based on the temporary target pump displacement volume and the temporary target engine rotation speed, which allows performing control corresponding to a first control based on the amount of operation of the actuator operation member (namely, positive control) and a second control based on the pump load pressure (namely, horsepower control) to be ensured, while increasing the pump displacement volume to restrain the engine rotation speed and to improve fuel efficiency.

The command section may, for example, set the final target engine rotation speed to a value obtained by dividing the target pump discharge amount by the maximum pump displacement volume, in the case where the temporary target pump displacement volume is equal to or smaller than the maximum pump displacement volume of the at least one hydraulic pump. This makes it possible to restrain the engine rotation speed and improve fuel efficiency by full utilization of the pump displacement volume of the at least one hydraulic pump.

On the other hand, it is preferable that the command section sets the final target engine rotation speed to a value not lower than a preset minimum target engine rotation speed. This prevents the engine rotation speed from an excessive decrease resulting from setting of a large pump displacement volume, for example, from a decrease that rather degrades the fuel efficiency of the engine.

The command section preferably sets the final target pump displacement volume so as to prevent a pump absorption torque corresponding to the final target pump displacement volume from exceeding a preset maximum torque. This allows the pump absorption torque to be prevented from excessive which involves inconvenience such as an engine failure.

The command section preferably performs control including suppressing a fluctuation in the final target engine rotation speed regardless of a fluctuation in the temporary target pump displacement volume, for example, control including preventing the engine rotation speed from decrease until a point in time when a preset time has elapsed or control including limiting a time-varying gain for the final target engine rotation speed to a set value or smaller, in the case where the final target engine rotation speed is equal to or higher than a set value, for example, in the case where the final target engine rotation speed reaches a value adjacent to the maximum engine rotation speed. This control makes it possible to solve a problem that the engine rotation speed fluctuates by following a frequent fluctuation in the amount of operation of the actuator operation member or the pump load pressure to thereby degrading operability.

The at least one hydraulic pump may include a plurality of hydraulic pumps. In this case, preferable is that the controller calculates the first-control target pump displacement volume, the temporary target pump displacement volume, the target pump discharge amount and the final target pump displacement volume individually for each of the plurality of hydraulic pumps.

This application is based on Japanese Patent application No. 2014-046419 filed in Japan Patent Office on Mar. 10, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hydraulic driving apparatus for a working machine, comprising:

an engine;

at least one variable displacement hydraulic pump driven by the engine to discharge a hydraulic fluid;

a hydraulic actuator supplied with the hydraulic fluid discharged by the hydraulic pump to be thereby actuated;

an engine operation member to which an operation for specifying a target rotation speed for the engine is applied;

an actuator-operation member to which an operation for specifying a speed of actuation of the hydraulic actuator is applied;

a pump-load-pressure detector that detects a load pressure on the at least one hydraulic pump;

an engine-operation detector that detects an amount of the operation applied to the engine operation member;

an actuator-operation detector that detects an amount of operation applied to the actuator operation member; and a controller that outputs a command for a pump displacement volume of the at least one hydraulic pump and a command for a rotation speed of the engine, based on the pump load pressure detected by the pump-load pressure detector and the amounts of respective operations detected by the engine-operation detector and the actuator-operation detector, wherein:

the controller includes: a temporary-target-engine-rotation-speed calculation section that calculates a temporary target engine rotation speed corresponding to the amount of operation applied to the engine operation member; a temporary-target-pump-displacement-volume calculation section that calculates a first-control target pump displacement volume corresponding to the amount of the operation applied to the actuator operation member and a second-control target pump displacement volume corresponding to the pump load pressure and selects a smaller one of the first-control target pump displacement volume and the second-control target pump displacement volume as a temporary target pump displacement volume for the at least one hydraulic pump; and a command section that calculates a final target engine rotation speed and a final target pump displacement volume based on the temporary target engine rotation speed and the temporary target pump displacement volume and outputs commands for the engine rotation speed and for the pump displacement volume based on the final target engine rotation speed and the final target pump displacement volume;

in the case where the temporary target pump displacement volume is larger than a maximum pump displacement volume of the at least one hydraulic pump, the command section performs setting the final target engine rotation speed to the temporary target engine rotation speed and setting the final target pump displacement volume to the maximum pump displacement volume; and in the case where the temporary target pump displacement volume is equal to or smaller than the maximum pump displacement volume of the at least one hydraulic pump, the command section performs: calculating a target pump discharge amount for an amount of hydraulic fluid discharged by the at least one hydraulic pump based on the temporary target engine rotation speed and the temporary target pump displacement volume: setting the final target pump displacement volume to a volume which is larger than the temporary target pump displacement volume and which is equal to or smaller than the maximum pump displacement volume; and setting the final target engine rotation speed to a specific engine rotation speed lower than the temporary target engine rotation speed, the specific engine rotation speed allowing a pump discharge amount equivalent to the target pump discharge amount to be obtained with the final target engine rotation speed and the final target pump displacement volume.

2. The hydraulic driving apparatus for a working machine according to claim 1, wherein the command section sets the final target engine rotation speed to a value obtained by dividing the target pump discharge amount by the maximum pump displacement volume, in the case where the temporary target pump displacement volume is equal to or smaller than the maximum pump displacement volume of the at least one hydraulic pump.

3. The hydraulic driving apparatus for a working machine according to claim 1, wherein the command section sets the final target engine rotation speed to a value not lower than a preset minimum target engine rotation speed.

4. The hydraulic driving apparatus for a working machine according to claim 1, wherein the command section sets the final target pump displacement volume so as to prevent a pump absorption torque corresponding to the final target pump displacement volume from exceeding a preset maximum torque.

5. The hydraulic driving apparatus for a working machine according to claim 1, wherein the command section performs control including suppressing a fluctuation in the final target engine rotation speed regardless of a fluctuation in the temporary target pump displacement volume, in the case where the final target engine rotation speed is equal to or higher than the set value.

6. The hydraulic driving apparatus for a working machine according to claim 1, wherein the at least one hydraulic pump includes a plurality of hydraulic pumps, and the controller calculates the first-control target pump displacement volume, the temporary target pump displacement volume, the target pump discharge amount, and the final target pump displacement volume individually for each of the plurality of hydraulic pumps.

* * * * *